US006298483B1

(12) United States Patent
Schiebl et al.

(10) Patent No.: US 6,298,483 B1
(45) Date of Patent: Oct. 9, 2001

(54) PROTECTIVE HEADGEAR AND CHIN PAD

(76) Inventors: Paul Schiebl, 8905 Chatsworth, Houston, TX (US) 77024; Marshall F. Holtsclaw, II, 6641 Evergreen Loop Rd., Leslie, MO (US) 63056

( * ) Notice: Subject to any disclaimer, the term of this patent is extended or adjusted under 35 U.S.C. 154(b) by 0 days.

(21) Appl. No.: 09/146,875

(22) Filed: Sep. 3, 1998

Related U.S. Application Data

(60) Provisional application No. 60/056,305, filed on Sep. 3, 1997.

(51) Int. Cl.[7] ..... A41D 13/00; A42B 3/08

(52) U.S. Cl. ..... 2/9; 2/421; 2/425

(58) Field of Search ..... 2/410, 411, 412, 2/413, 414, 421, 424, 425, 9

(56) References Cited

U.S. PATENT DOCUMENTS 3,447,163 * 6/1969 Bothwell et al. ..... 2/412
3,935,044 * 1/1976 Daly ..... 2/412
4,075,717 * 2/1978 Lemelson ..... 2/412
4,282,610 * 8/1981 Steigerwald et al. ..... 2/414
4,651,356 * 3/1987 Zide ..... 2/421
4,831,668 * 5/1989 Schulz ..... 2/414
4,916,759 * 4/1990 Arai ..... 2/414
5,088,129 * 2/1992 Kamata ..... 2/411
5,330,249 * 7/1994 Weber et al. ..... 297/214
5,483,699 * 1/1996 Pernicka et al. ..... 2/9
5,685,020 * 11/1997 Powell et al. ..... 2/421
5,687,426 * 11/1997 Sperber ..... 2/411
5,815,846 * 10/1998 Calonge ..... 2/413

* cited by examiner

*Primary Examiner*—Michael A. Neas
(74) *Attorney, Agent, or Firm*—Howrey Simon Arnold & White, LLP; William D. Durkee

(57) ABSTRACT

Protective headgear comprises a rigid shell with face pads which may be released and removed while the headgear is still on a person's head. A protective chin guard may be attached to the headgear by way of the face pads. The chin guard comprises a substantially rigid shell with a removeable insert made of a flexible bladder filled with a shock absorbing fluid. The headgear may comprise a shell made of an inner and outer material layered over an internal foam core to effect both strength and lightweight.

10 Claims, 5 Drawing Sheets

52
54

40
44
50
44
46
46
44
68
46
42

66
62

70
60
56
58
64
56
72

74

PROTECTIVE HEADGEAR AND CHIN PAD

CROSS REFERENCE TO APPLICATIONS

This application claims priority from provisional patent application serial No. 60/056,305 filed on Sep. 3, 1997, entitled PROTECTIVE HEADGEAR.

BACKGROUND OF THE INVENTION

The invention relates to improvements in protective headgear such as football helmets, motorcycle and bicycle helmets, and helmets for other activities where protection from head impact and injury is desirable. The invention also relates to protective pads, particularly chin pads.

Protective helmets to minimize head injuries have been known and used for many years, but the known helmets can be improved. For example, football helmet shells have been produced from injection molded ABS, or polycarbonate plastic. Helmets intended for youth usage have usually been produced from ABS plastic, and helmets for adult usage have usually been produced from polycarbonate plastic. ABS plastic is significantly less expensive than polycarbonate, but ABS plastic is not as structurally rigid as polycarbonate. As the level of intensity of contact in youth football is significantly lower than that at the adult level, ABS has been accepted as a satisfactory material for use at the youth level. For adult helmets, however, the structural rigidity of the polycarbonate material is essential to minimize the flex and deformation of the shell under extreme impact conditions.

The National Operating Committee on Standards for Athletic Equipment (NOCSAE) has been responsible for setting minimal performance criteria for football helmets. The minimum standard acceptance level measured by the Severity Index (SI) is set at 1200. Through the continuous testing of NOCSAE, it has been established that the rigidity of polycarbonate shells, in comparison to ABS shells, leads to significantly lower SI results. From these tests, it is believed that there is a correlation between the rigidity of the shell material and improved safety performance.

Protection can also be improved by the addition of a face mask attached to the helmet. For example, football helmets are usually equipped over the exposed face area with a vinyl coated wire or other metal structure, or an injection molded plastic face mask. The obvious purpose of the face mask is to protect the face of the player from injury, while not obstructing the players'vision unnecessarily. Addition of a face mask can also increase the rigidity of the shell which improves the SI performance. Helmets are usually tested without face masks so that the SI performance of a helmet with the mask will somewhat exceed the test standard.

Face masks have been mounted to the exterior surface of the helmet shell behind the front edge of the helmet face opening. This design can, under certain conditions, contribute to serious injury. Helmet shells are specifically designed with smooth spherical surfaces to allow the shells to glance and slide on impact. The mounting of the face mask on the outer surface creates the potential that the masks of two players hitting could become engaged as their helmets are glancing, changing the directional forces and causing the potential for serious injury.

Protective helmets usually include a chin strap to hold the helmet on, particularly during impact. In the past, chin straps were frequently constructed using a molded plastic cup made of compression or injection molded plastic material. A pad, usually of a felt or foam material, was bonded or otherwise attached to the plastic cup. This cup construction is preferable to non-padded chin straps which have been standard equipment on football helmets. Non-padded chin straps do not offer any impact protection to the chin area, and only serve to secure the helmet to the player's head. Padded chin cups provide an added measure of protection to the chin from impacts, in addition to securing the helmet to the player's head.

Improvement in the impact absorption performance of padded chin straps is desirable. The molded plastic chin cups currently used are molded in a manner which allows the formed cup to flex upon impact. An improved construction is a rigid material which does not flex on impact to an undesirable degree, thus distributing the impact force over a larger area of the chin.

Another shortcoming of existing chin straps is that the padding material is permanently bonded to the plastic chin cup. As football is often times played in muddy conditions, these pads tend to become dirty. Sweat and body oil accumulate and compound the problem of how to keep the product clean and sanitary over extended use.

One key to improved SI performance is related to the stiffness of the protective shell. The invention provides helmet shells which can increase the rigidity of the shell, resulting in improved SI performance. An additional and significant benefit can be a substantial reduction of weight in comparison to the current plastic shells being produced. These same methods and structures may be applied to protective headgear other than football helmets, and to chin cups.

BRIEF SUMMARY OF THE INVENTION

The invention provides protective headgear and a novel chin guard which are particularly useful in situations which involve impact, such as football, baseball, and cycling. The chin guard involves a flexible insert to improve shock absorption and to allow replacement when ruptured or when needed for cleanliness. The preferred insert is a flexible bladder filled with viscous liquid which fits into a chin cup in a removeable manner.

The preferred helmet is made of substantially rigid material which is shaped to be non-removeable with face pads in place. The face pads are designed to hold the helmet in place on a person's head until they are removed while the helmet is still in place on the person's head.

Another aspect of the invention involves a helmet made of a composite, sandwich construction with a foam core to provide rigidity while keeping weight of the helmet low.

DESCRIPTION OF ILLUSTRATIVE EMBODIMENTS

Figure 1:
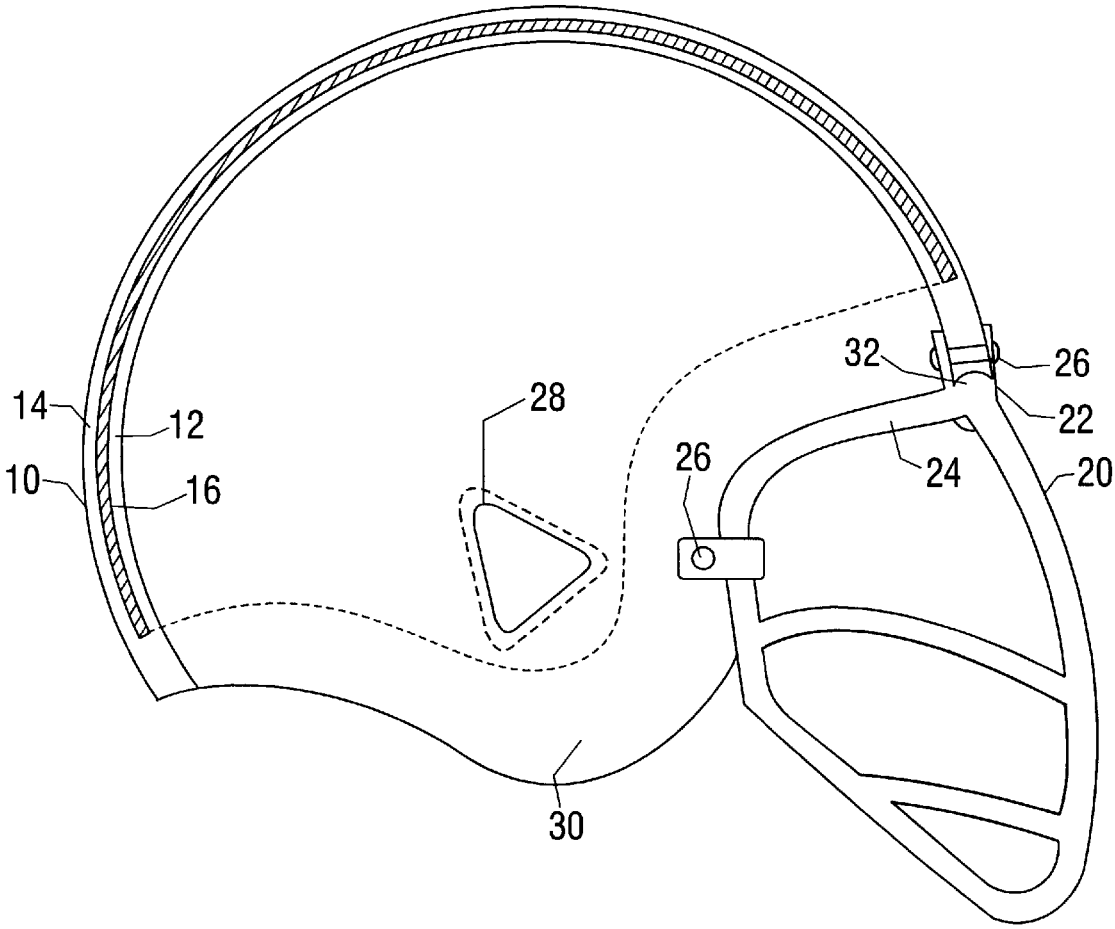
FIG. 1 is a perspective view, partially in section, of a helmet in accordance with the invention.

One aspect of the invention involves a helmet made of a high strength composite material for protection of the wearer. With reference to FIG. 1 the helmet 10 may be a single layer of substantially rigid material or it may be an inner layer 12 and outer layer 14 permanently bonded to an inner rigid foam core 16 to form a rigid shell of relatively light weight. By constructing the shell in this manner, the inner relatively lightweight core will maintain separation of the inner and outer high strength layers. Constructing the shell in this fashion will significantly increase the rigidity of the shell. For deflection to occur, the outer composite material must stretch, while the inner composite material would need to compress. Due to the high tensile strength and compression resistance of the composite materials deflection on the shell is reduced to a negligible level.

The composite material is preferably made of a strong, lightweight fiber or woven fabric, such as Kevlar or Fiberglas, impregnated with a resin, such as an epoxy resin. The resin is preferably thermoplastic to make forming easier. A thermoplastic epoxy sheet may be used in forming the composite material. Such sheets are available from Performance Materials Corp., Camarillo, Calif. The core which is preferably made of polyethylene foam, is important to the performance requirements. Although it may be possible to produce a shell of either a single composite layer, or multiple composite layers, without the lightweight foam core spacing the inner and outer layers, the deflection properties of these shells would not match those of the laminated core shell when weight of the shell is considered. There would be a significant weight difference due to the amount of composite material which would be necessary to meet the performance criteria.

Due to the spherical shape of the helmet shell, compression forming of the inner and outer shells in one place would be difficult. Although the inner and outer shells could be formed in halves and joined, the preferable method is to have each shell component produced complete and ready for bonding to the foam core. It is preferred to use a wet lay-up process to produce the inner and outer composite components. A collapsible core head form mold can be used for the initial material lay-up. The mold core would be sprayed with a resin compound to assure a smooth inner surface on the finished part. On this, the operator would lay pre-cut sheets of fiber to cover the head form. Additional resin would be applied to form the inner layer of composite material. The operator would then position the preformed rigid foam core onto the head form. An additional layer of resin would be applied to the foam core on which the operator would lay pre-cut sheets of fiber to cover the foam core. A final layer of resin would be applied to assure a smooth surface finish. The outer mold would be two half molds, which would close and compress the material to insure a precise material thickness. During this process a vacuum would be pulled prior to the resin curing to remove all entrapped air pockets. It will also be necessary to rotate the mold so that the crown of the shell is facing down. This will allow the entrapped air to be evacuated along the leading edge of the shell. Upon completion of the curing process, the shell will be removed from the mold and will be trimmed of all mold flash.

The lightweight foam core is preferably a rigid, high density, cross-linked polyethylene foam (thermoplastic) which can be purchased in sheet stock from Zotefoam, Inc., Hacketstown, N.J., 07840. The sheet stock is shaped on a mold in a separate compression forming operation with heat.

With reference to FIG. 1, a face mask 20 is attached to the shell 10 with a holding U-shaped bracket 22 attached to the shell 10. The bracket 22 fits over a bar 24 of the face mask 20 and is held in place by rivets 26 which extend through a hole in the shell 10. An ear hole 28 is formed in the shell 10 on each side of the helmet. The ear hole 28 can be molded in while making the shell 10 or it can be drilled or punched through the shell 10 after molding.

The bottom periphery 30 of the shell 10 need not contain the foam core 16. This bottom periphery 3 may be formed from the inner and outer composite material to provide a clean edge around the bottom of the helmet and to protect the core.

Another improvement in accordance with the invention is the area of attachment for the face mask. With reference to FIG. 1 the area where the mask is to be attached has been recessed into the shell 10 with a concave radius 32 along the front edge of the shell 10 and the diameter of the bar 24 of the face mask 20 for attachment is about equal to the width of the concave recess 32. The benefit of the design is two fold. By recessing the face mask mount into the leading edge of the shell the desired continuous spherical shape of the helmet is maintained. This will significantly reduce the possibility of the face mask snagging on a glancing blow to the helmet. By recessing the face mask mounting area along the leading edge, it also structurally reinforces this area leading to added improved SI performance. It should be noted that the same construction can be utilized when this recessed mounting is added to a conventional molded polycarbonate shell. This new technology is a significant breakthrough in enhanced performance football protective headgear, and is applicable to all forms of protective headgear and other products which protect against impact.

The remaining outer edge of the shell 10 is preferably rounded out to form a smooth arcuate edge. The remaining outer edge may also be covered with a resilient channel fitting over the edge. Extruded rubber or foam could be used.

The preferred method detailed herein utilizes composite materials, preferably a strong fabric impregnated with a curable resin, permanently bonded to a rigid foam core in order to achieve optimum performance results. Other similar or like materials, however could be constructed in this fashion with the result being enhanced performance over currently available technology. Our invention includes within its scope other types of materials for use in the described reinforced, sandwich reinforced construction which may be necessary or appropriate.

As shown in FIG. 1, the outer lower edge (bottom periphery 30) of the helmet does not contain foam. It consists of the composite layers bonded together to form a strong outer composite area of the shell. Holes may be drilled through this composite area for attaching a face mask or other face cover, such as a transparent or vision improving shield. Ear holes 28 are preferably provided in each side of the helmet. These holes may be made by high pressure water jet cutting. They may be any shape, including circular, triangular, rectangular, oval and the like.

Figure 2:
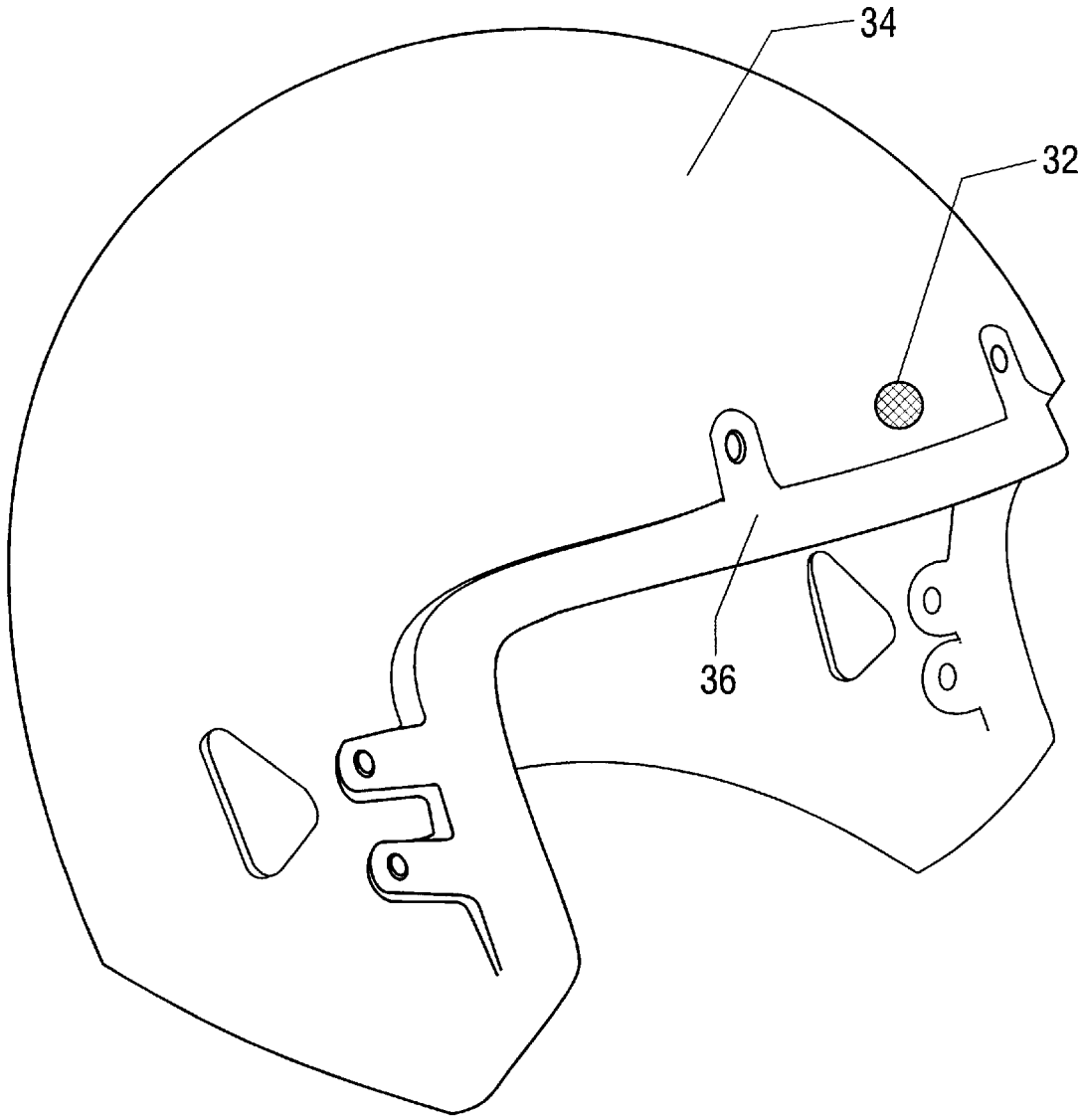
FIG. 2 is a perspective view of a helmet in accordance with the invention.

The helmet may also include an impact warning device 32 in a shell 34 as illustrated in FIG. 2, such as a safety dot on the front of the shell 34 which will change color upon impact above a certain or predetermined level. The safety dot may be activated by a battery operated circuit controlled by an inertial switch designed to close the circuit and change the color of the safety dot upon impact above the selected level. The shell 34 in FIG. 2 also illustrates a recessed area 36 along the front edge of the shell 34 to accept hardware for mounting a face mask. The recessed area may be molded into the helmet. The recessed area allows the outside of the face mask hardware to be smooth with the outer surface of the shell 34.

The helmet may also include jaw pads to conform the helmet to the shape of the head. Since the helmet should not flex to get it on or off with the jaw pads in place, the jaw pads should be insertable and removable, or inflatable and shrinkable, with the helmet in place on the head. Inflatable jaw pads connected to a valve reachable through a hole in the helmet, such as at the top of the helmet, can be used.

Thus the preferred protective shell in accordance with the invention is made by permanently bonding two thin separate high tensile strength materials to a lightweight core constructed of a high tear strength, high shear strength material. This structure will minimize flex and deformation under impact but will also be lightweight. This structure may also be utilized for a chin cup construction. A thin lightweight composite material is the preferred material to use as a protective chin cup. However, any thin high tensile strength material would also be an improvement over the existing available products.

A core constructed of a rigid, high-density, cross-linked polyethylene foam which bonds to the inner and outer composite layers is the preferred material to use as the core material. However, any material permanently bonded to and separating the outer and inner composite layers would also offer an improvement over the existing available products.

By permanently bonding the outer plates of the composite or other material with the foam core or other core material, an extremely rigid non-deflecting chin cup can be achieved which will disperse the force of an impact over the entire padded cup area.

An additional feature of the chin strap of the invention is that the construction allows for easy replacement of the pad. By pre-molding the core material with a lip, which would extend beyond the edges of the inner and outer composite plates, a preformed cradle will hold in place a replaceable pad system. Double stick tape may also be employed. This construction allows for multiple padding systems to be used in conjunction with the chin cup assembly, and for easy replacement. A pad made of lambs wool, either natural or artificial, is also a suitable alternative, particularly in cold climates.

The pad systems may also consist of disposable shock absorbing pads which may be treated with anti-bacterial and anti-fungicidical inhibitors. Such replaceable pads offer superior protection in addition to improved sanitary conditions for the wearer.

Another pad system consists of a liquid, semi-liquid, foam, or gelled material encapsulated within a urethane film, such as J. P. Stevens 8 mil urethane film ST-1528-83. This pad system equalizes the pressure on all contact areas ensuring the equal distribution of impact force over the padded area. A currently preferred pad is composed of a urethane film envelope containing a liquid made from Shelflex mineral oil (Shell Oil Co.) and Kraton ethylene/butylene copolymer (Shell Oil Co.). The liquid may also be glycerin.

With reference to FIGS. 3 to 8, a shell 40 has a face mask 42 attached to shell 40 by U-shaped brackets 44 which are held in place by screws 46 which engage threads in the shell 40 and which allow the face mask to be removed while the helmet is on a person's head. The face mask 42 is preferably made from a hollow alloy (note FIG. 8) to make it lightweight. A shock indicator 50 is located on the front of the shell 40.

Figures 3, 4, 5, 6, 7, 8:
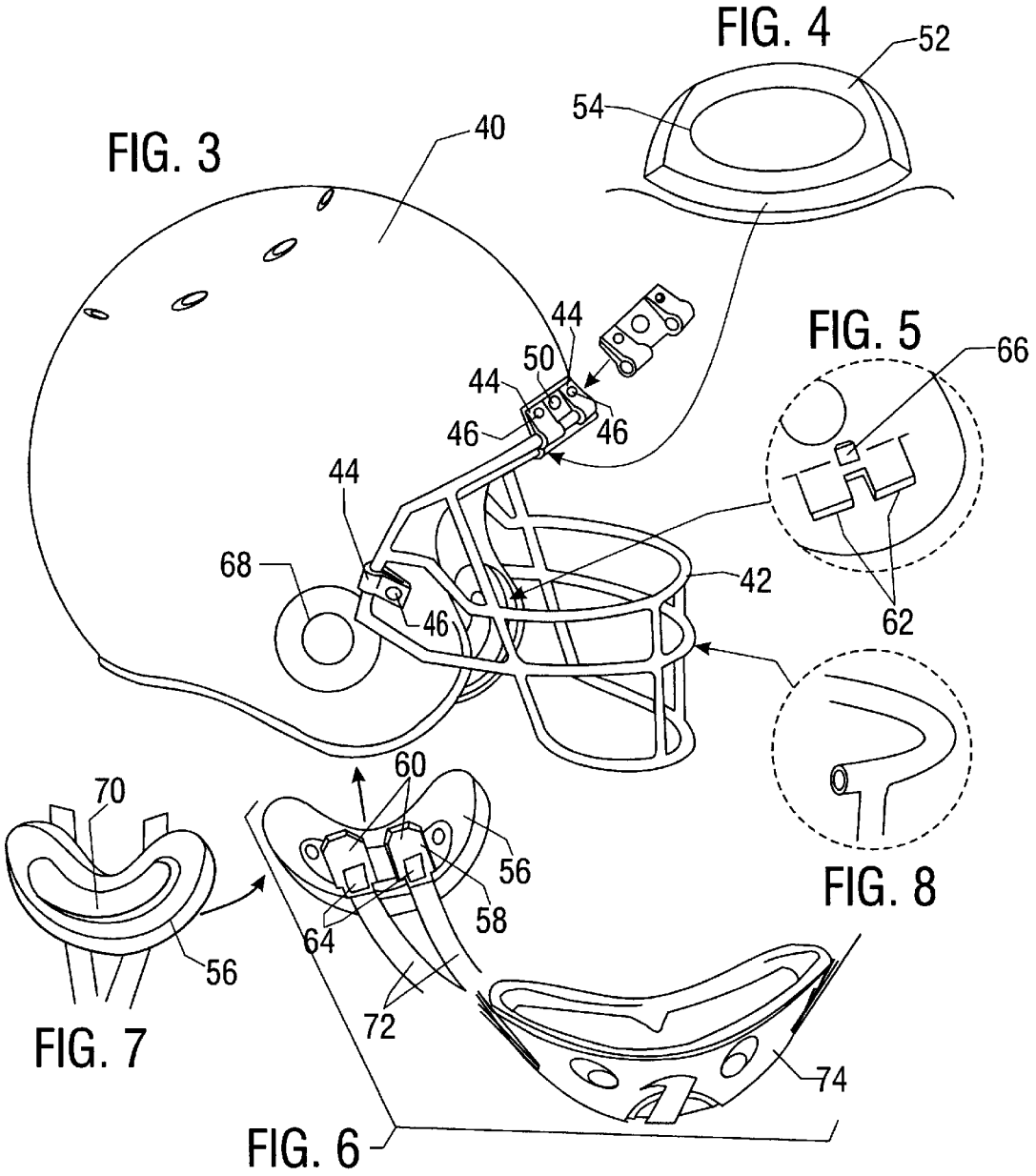
FIG. 3 is a perspective view of a helmet in accordance with the invention.
FIG. 4 is a perspective view of a forehead pad for the helmet of FIG. 3.
FIG. 5 is a perspective view of a catch and release for the helmet of FIG. 3.
FIG. 6 is a perspective view of a face pad and chin guard for the helmet in FIG. 3.
FIG. 7 is a perspective view of the opposite side of the face pad in FIG. 6.
FIG. 8 is an illustration of the hollow face mask in FIG. 3.

With reference to FIG. 4, a forehead pad 52 contains a gel 54. The gel 54 may be attached to the pad 52 in any suitable manner, including glue or removeable attachment such as a gel pad under a peripheral lip in a recess in the pad 52. The pad 52 may be attached to the shell 40 by conventional straps or other suitable ways.

Face or jaw pads 56 have a clip 58 which has two legs 60 which slide up into female catch openings 62 attached to the shell 40. Two catches 64 engage recesses in the catch openings 62 to hold the face pad 56 in place. A release 66 releases the clip 58 from the female openings 62. The release 66 may be actuated by inserting a finger through the ear hole 68 in the shell 40.

With reference to FIGS. 6 and 7, the face pad 56 may contain a gel insert 70 on the side adjacent the face. The clip 58 is also connected to a pair of woven nylon straps 72 which carry a chin cup 74. Chin cup 74 is also fixed to the shell 40 on the other side of the face in a similar manner.

Chin cup 74 is further illustrated in FIGS. 9 to 13. Chin cup 74 in FIG. 9 has woven straps 72 which fit through and around holes 76 in the chin cup 74 to secure the straps to the chin cup. Chin cup 74 contains a resilient layer 78 which may be affixed to chin cup 74 in any suitable manner, such as adhesive tape or glue. Cup insert 80 fits into the resilient layer 78. Layer 78 may be made of any suitable material including foam, rubber, lamb's wool. etc. Insert 80 is preferably a plastic film containing a viscous gel.

Figure 14:
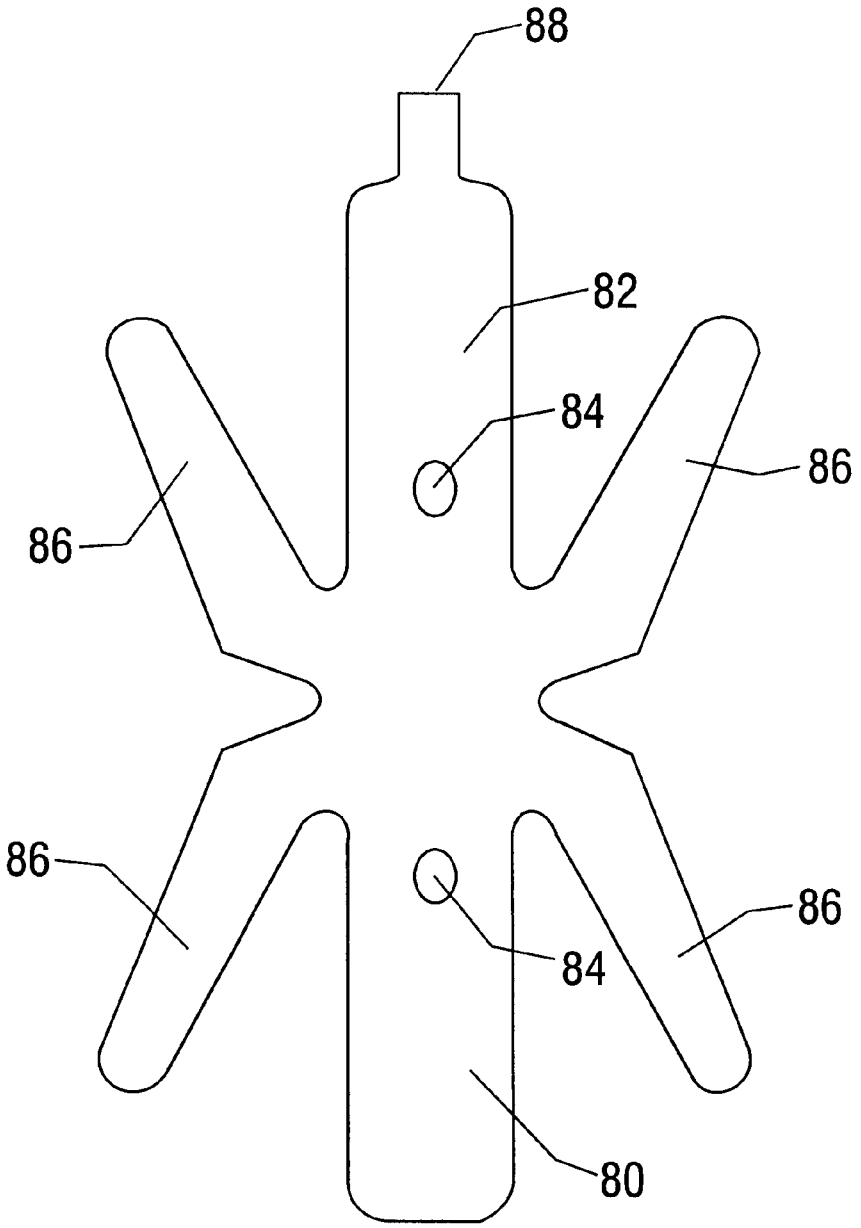
FIG. 14 is a plan view of the insert illustrated in FIGS. 12 and 13.

FIG. 14 illustrates a preferred embodiment of insert 80. Insert 80 preferably comprises a rectangular portion 82 containing two areas 84 which are made by welding the upper and lower sides of the film of insert 80 together. Along opposite sides of the portion 82 are fingers 86. The interior of fingers 86 and portion 82 communicate to allow fluid to move within on impact. The areas 84 dampen flow to improve shock absorption. End 88 allows for insertion of the gel into insert 80 and then sealing of the end 88.

Areas 84 can also be formed to mate with extensions on the resilient layer 78 to snap the insert 80 in place for use and then subsequent removal.

Figure 12:
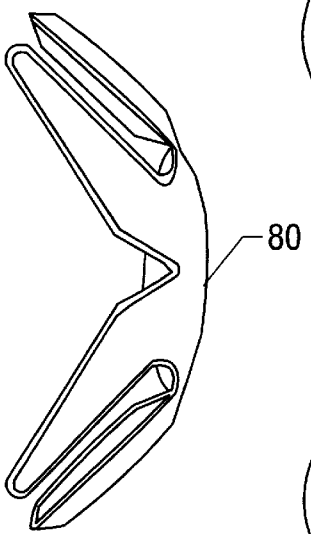
FIG. 12 is a perspective view of a chin cup insert which fits into the chin cup of FIGS. 9 to 11.
Figure 13:
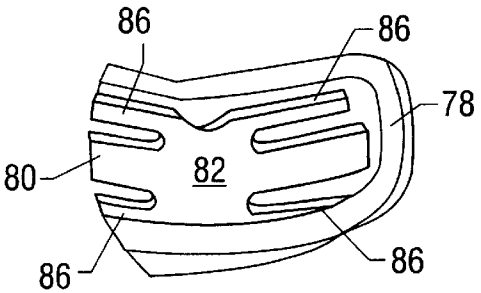
FIG. 13 is a front perspective view of the insert of FIG. 12 in place in the chin cup of FIGS. 9 to 11.

The fingers 86 of insert 80 are shown in FIG. 12 fitting along the rectangular portion 82. The fingers 86 are shaped to extend outward and then toward an end of portion 82. They bend upon insertion into the chin cup and help hold the insert 80 in place within the resilient layer 78.

Figure 9:
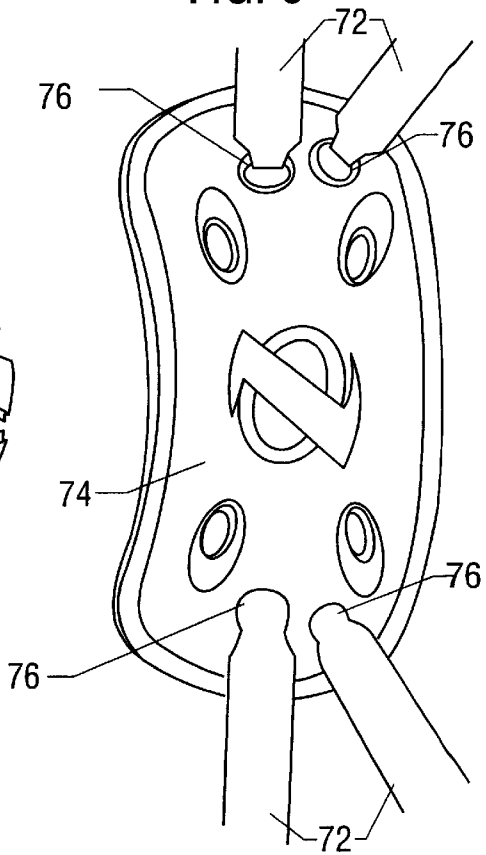
FIG. 9 is a perspective view of a chin strap and chin cup in accordance with the invention.
Figure 10:
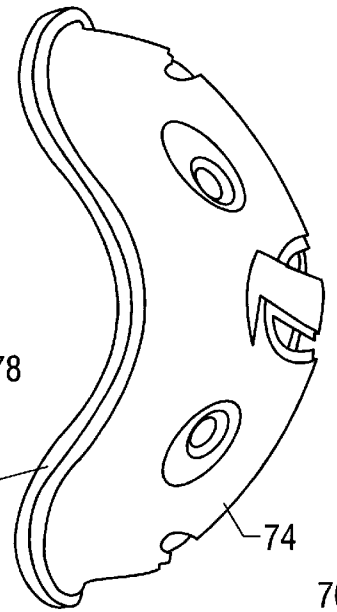
FIG. 10 is a top perspective view of the chin strap and cup in FIG. 9.
Figure 11:
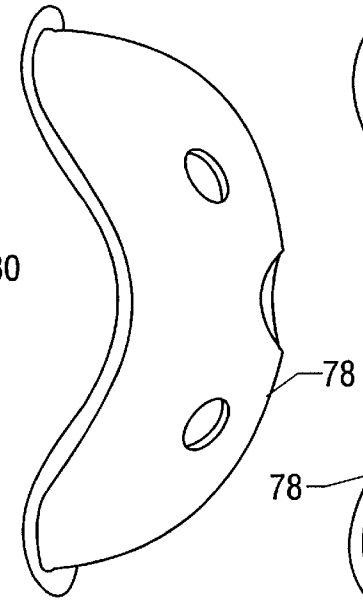
FIG. 11 is a perspective view of the resilient layer in the chin cup of FIG. 10.

The chin strap is preferably divided on either side to have four points connected to the helmet, as illustrated in FIGS. 6 and 7. A chin strap made of nylon webbing which does not stretch is the currently preferred material for the strap. Nylon webbing from U.S. Webbing, Inc., El Monte, Calif., has been found suitable. This webbing is a flattened tube of nylon to form a strap. Logos and other information may be woven into the webbing. The four points can be connected with suitable snaps or other connections. The information or logos can also be painted on the strap, or applied to it in some other manner. The main portion of the chin strap may extend through the chin cup to secure the chin cup in place. Rivets or other fasteners may also be employed to secure the strap to the chin cup, but the design illustrated in FIGS. 5 and 9 is preferred.

Other materials, which may now exist or may be developed in the future, can be used to accomplish the purpose of conforming to the chin of the wearer and providing protective cushioning from impact on the rigid non-deflecting chin cup. Similarly, headgear in accordance with the invention may be made of materials which are not specifically identified herein, or which may be developed in the future, as long as the structure and purposes of the invention are achieved. The above description is not intended to limit the invention or its various aspects to the particular embodiments illustrated.

What is claimed is:

1. A protective chin guard comprising:

a) a substantially rigid shell shaped in the form of a cup to fit over a person's chin;

b) a foam layer attached to the inside of the shell;

c) a flexible bladder containing a shock-absorbing fluid disposed over the foam layer to fit against the person's chin; and d) straps associated with the rigid shell to allow attachment to a protective headgear.

2. The protective chin guard of claim 1 in which the flexible bladder is replaceably attached to the foam layer.

3. The protective chin guard of claim 2 in which the flexible bladder is replaceably attached by adhesive tape.

4. The protective chin guard of claim 2 in which the flexible bladder and the foam layer contain mating snaps for replaceable attachment.

5. The protective chin guard of claim 2 in which the flexible bladder and the foam layer contain mating strips of hook and loop attachments.

6. In a protective chin guard comprising a substantially rigid shell shaped in the form of a cup to fit over a person's chin, a) a flexible bladder shaped and sized to fit in the cup-shaped shell and against a person's chin; and b) a shock-absorbing fluid in said bladder, c) the flexible bladder comprising a rectangular center portion sized to extend across the inside of the cup-shaped shell and flexible fingers extending from both sides of the rectangular portion to fold alongside the rectangular portion when placed inside the shell.

7. The flexible bladder of claim 6 in which the interiors of the rectangular portion and the fingers communicate to allow movement of the shock-absorbing fluid.

8. The flexible bladder of claim 6 in which the fluid is a viscous liquid.

9. The flexible bladder of claim 8 in which the viscous liquid is a gel.

10. A flexible insert for a chin guard comprising:

a) a flexible bladder comprising a rectangular portion adapted to fit inside and across the chin guard;

b) four flexible fingers extending away from opposite sides of the rectangular portion, each finger extending away from the rectangular portion and then generally toward an end of the rectangular portion for fitting along a side of the rectangular portion when inserted in the chin guard; and c) shock-absorbing fluid in the rectangular portion and the flexible fingers.

* * * * *